US007980752B2

(12) United States Patent
Sarvazyan

(10) Patent No.: US 7,980,752 B2
(45) Date of Patent: Jul. 19, 2011

(54) APPARATUS FOR ULTRASONIC STIRRING OF LIQUIDS IN SMALL VOLUMES

(75) Inventor: Armen P. Sarvazyan, Lambertville, NJ (US)

(73) Assignee: Artann Laboratories Inc, Trenton, NJ (US)

( * ) Notice: Subject to any disclaimer, the term of this patent is extended or adjusted under 35 U.S.C. 154(b) by 819 days.

(21) Appl. No.: 12/034,789

(22) Filed: Feb. 21, 2008

(65) Prior Publication Data

US 2009/0052273 A1 Feb. 26, 2009

Related U.S. Application Data

(62) Division of application No. 11/841,456, filed on Aug. 20, 2007, now abandoned.

(51) Int. Cl.
*B01F 11/00* (2006.01)

(52) U.S. Cl. ..... 366/114; 366/116; 366/127

(58) Field of Classification Search ..... 366/114, 366/115, 116, 127
See application file for complete search history.

(56) References Cited

U.S. PATENT DOCUMENTS 4,398,925 A * 8/1983 Trinh et al. ..... 95/30
4,759,775 A * 7/1988 Peterson et al. ..... 210/708

* cited by examiner

*Primary Examiner* — David Sorkin
(74) *Attorney, Agent, or Firm* — Boris Leschinsky

(57) ABSTRACT

Ultrasound-assisted contactless stirring of liquids in a resonator cell by microparticles is achieved by repeated creating and destruction of nodal patterns associated with standing waves of various resonance frequencies causing continuous movements of microparticles inside the cell. Swept-frequency sonication technique includes using constant or variable rate of frequency change as well as a stepwise change of frequency of the transducer within a predefined range. Other useful provisions include initial detection of the set of resonance frequencies and periodic refreshing of that set. Control systems are described including means to automatically detect the resonance frequencies and maintain the operation of the transducer thereon. Advantageous designs of the apparatus are described for use in microstirring, mixing of liquids using magnetic microbeads, microbubbles, microtiter plates, microarray plates, etc.

7 Claims, 7 Drawing Sheets

APPARATUS FOR ULTRASONIC STIRRING OF LIQUIDS IN SMALL VOLUMES

CROSS-REFERENCE DATA

This application is a divisional application of the co-pending U.S. patent application Ser. No. 11/841,456 by the same inventor as filed on Aug. 20, 2007 and entitled "Ultrasonic Stirring of Liquids in Small Volumes".

FIELD OF THE INVENTION

The present invention relates to an apparatus for ultrasonic contactless stirring and mixing of small amounts of liquids. More specifically, the invention relates to the use of a swept-frequency mode of sonication to induce rapid motion of microparticles suspended in the liquid such that these microparticles cause efficient stirring of the liquid. The invention can be best utilized to facilitate various processes, which require mixing, agitation, and stirring of small volumes of liquids.

BACKGROUND OF THE INVENTION

Stirring and mixing liquids is a necessary part of many industrial, chemical and pharmaceutical technological processes. The majority of these industrial processes are carried out on macroscopic levels. It has only been in the recent years that mixing of small quantities of liquids has become technologically relevant in the context of microfluidics since mixing is often crucial to the effective functioning of devices manipulating with small quantities of liquids. (Nguyen, N. & Werely, S. 2002 Fundamentals and applications of microfluidics. Boston, Mass.). Microfluidic devices are useful in various biological and chemical applications, including such diverse fields as biochemical analysis, drug screening, genetic analysis, medical diagnostics, chemical synthesis, and environmental monitoring. One exemplary important application of microfluidics is in biochemical sensing techniques such as immunoassays and hybridization analyses, which require rapid, homogeneous mixing of macromolecular solutions, such as DNA or proteins. Achieving effective stirring and mixing in macroscopic volumes of fluids is a relatively straightforward task. Various conventional mechanically or magnetically driven stirring elements may be employed. Alternatively, special geometries may be employed in flow channels to promote mixing without the use of moving elements.

Stirring and mixing in small volumes is, however, difficult. Applying conventional mixing strategies to microfluidic volumes is generally ineffective. Various designs of micromixers have been proposed in recent years. There are several publications that comprehensively review mixing methods and devices developed for microfluidic applications (see for example Christopher J. Campbell and Bartosz A. Grzybowski. Microfluidic mixers: from microfabricated to self-assembling devices. Phil. Trans. R. Soc. Lond. A (2004) 362, 1069-1086; and Julio M. Ottino and Stephen Wiggins. Introduction: mixing in microfluidics. Phil. Trans. R. Soc. Lond. A (2004) 362, 923-935).

Mixing methods are usually classified as either passive or active. Passive mixers have no moving parts and achieve mixing by virtue of their topology alone, while active mixers either do have moving parts or they use externally applied magnetic, electromagnetic or acoustic field. For example, U.S. Pat. Nos. 6,877,892; 6,890,093 and 6,935,772 issued to Karp et al. disclose devices for mixing multiple fluid streams passively using structures such as channel overlaps, slits, converging/diverging regions, turns, and/or apertures. The devices include microfluidic channels that are formed in various layers of a three-dimensional structure. U.S. Patent Application No. 20060280029 filed by Garstecki et al. discloses a microfluidic mixer that includes a channel having an inlet that separates into at least two branches, the branches then recombining into a single outlet.

Although performance of these devices is in many cases satisfactory, their fabrication is usually a tedious, multi-step process. The lack of moving parts makes passive mixers free of additional friction and wear effects, but their intricate channel topologies are often hard to fabricate, and they are generally not switchable: once incorporated into a fluidic system, they perform their function whenever fluids pass through them.

In contrast, active mixers can be controlled externally, which makes them suitable as components for reconfigurable microfluidic systems: that is, systems that can perform several different functions given different states of external controls. Active micromixers are known to be of two types: with and without moving parts. The moving parts can be microscopic stirrer bars, piezoelectric membranes or oscillating gas bubbles. The mixing can be achieved also without moving parts by action of electrical or acoustic fields on the liquid. U.S. Pat. No. 7,081,189 issued to Squires et al. discloses one example of a microfluidic mixer driven by induced-charge electro-osmosis applied to electrolyte fluids. Liu et al. developed an approach to micromixing based on acoustic microstreaming around an array of small air bubbles resting at the bottom of the mixing chamber (Liu, R., Lenigk, R., Druyor-Sanchez, R. L., Yang, J. & Grodzinski, P. 2003 Hybridization enhancement using cavitation microstreaming. Analyt. Chem. 75, 1911-1917). When the bubbles were made to vibrate by a sound field, they created steady circular flows around them. U.S. Pat. No. 6,244,738 issued to Yasuda et al. discloses ultrasonic vibrators arranged in the stirring tube where plural sample solutions to be mixed are stirred and mixed by an acoustic streaming induced by ultrasonic vibration.

One of the areas where microstirring is important is in the bead-based immunoassays, such as the latex agglutination test (LAT) used for identification and quantification of analytes, biomolecules and other substances of biological importance. LAT is widely used in point-of-care tests for diagnostic purposes, as well as in drug discovery/proteomics research, and in food-industry quality controls due to its simplicity, low cost and speed. There are several drawbacks of the particle agglutination methods such as long time of analysis dictating therefore the need for mechanical rotational motion of glass slides to accelerate the agglutination process; and a limited analytical sensitivity of the assay because of formation of nonspecifically bound aggregates. Effective microstirring may enhance bead-based assay by first accelerating immunochemical reaction and then by destroying nonspecifically bound aggregates and improving signal-to-noise ratio in quantitative assessment of the amount of immunochemically bound aggregates.

It is known to employ acoustic energy and specifically the phenomenon of a standing wave to manipulate particles suspended in a fluid, for example, to separate different types of particles from a liquid or from each other. The use of a nodal pattern of a standing wave associated with a single resonance frequency for particle capture and manipulation is described in detail for various patents, for example as listed below (these patents are incorporated herein in their entirety by reference):

| | | | | | |
|---|---|---|---|---|---|
| 4,055,491 | 4,280,823 | 4,398,925 | 4,523,632 | 4,523,682 | 4,673,512 |
| 4,759,775 | 4,877,516 | 4,879,011 | 5,006,266 | 5,527,460 | 5,613,456 |
| 5,626,767 | 5,688,406 | | | | |

as well as in the US Patent Application No. 2006037915 and international application No. PCT/AT89/00098.

The forces responsible for redistributing particles in the liquid in accordance with the nodal pattern of an ultrasonic standing wave depend on the relative density and acoustic impedance of the particles with respect to the fluid in which they are suspended, the dimensions of the particles and the frequency of the standing ultrasonic wave. Ultrasound radiation force drives the particles to the local particle potential energy minima within the pressure nodal planes, to give concentration regions that appear as clumps striated at half-wavelength separation (W. L. Nyborg, Mechanisms for nonthermal effects of sound, J. Acoust. Soc. Am., 1968, 44, 1302-1309; Wiklund M, Hertz H M. Ultrasonic enhancement of bead-based bioaffinity assays. Lab Chip. Oct. 6, 2006 (10): 1279-92, incorporated herein in its entirety by reference).

Although the use of a nodal pattern of a single resonance frequency standing wave is well described in the prior art for capturing and manipulating particles, there is no mentioning of using swept-frequency mode of generation of standing waves of multiple frequencies for liquid stirring and mixing.

Thus, there is a need for a device capable of thoroughly and rapidly mixing small volumes of fluids in a microfluidic environment.

SUMMARY OF THE INVENTION

Accordingly, it is an object of the present invention to overcome these and other drawbacks of the prior art by providing novel apparatuses for rapid and effective stirring of liquids in small quantities.

In accordance with the present invention, there are provided apparatuses for stirring and mixing liquids using a swept-frequency mode of ultrasonic exposure inducing rapid motion of microparticles suspended in the liquid to facilitate various processes, which require mixing and stirring.

The apparatus of the invention is based on providing an acoustic resonator cell containing a sample liquid and a suspension of microparticles. An ultrasound transducer acoustically coupled to the resonator cell is activated by the control system, which drives the transducer at frequencies in a range as described below.

In a swept-frequency mode of sonication, the transducer is driven in a range of frequencies varied between a predefined minimum and maximum frequencies. These minimum and maximum frequencies are selected to include therebetween at least two or preferably many (more than 10 in certain cases) resonance frequencies (also referred to as harmonics) of the liquid in the resonator cell. When one such resonance frequency is reached by the system, a standing wave is formed in the liquid defining a particular nodal pattern. When another such resonance frequency is reached, another nodal pattern is formed, which is different from the previous nodal pattern. Every time a nodal pattern is formed, microparticles are urged to move to a plurality of potential energy minima locations associated with that nodal pattern. When that nodal pattern is destroyed and a new nodal pattern is formed, the microparticles are urged to move to a new plurality of locations. The rate of frequency change in the swept-frequency sonication may be constant, variable or stepwise. It is selected to be such that the duration of existence of each nodal pattern is sufficiently long to allow microparticles to reach their plurality of locations, typically in the range of several milliseconds. At the same time, the change in frequency should be fast enough to provide efficient stirring. In a typical example with 3 to 10 resonance frequencies present in a particular swept-frequency range, between 1 to 100 sweeps per second should be conducted to ensure proper stirring of liquid.

When constant rate of frequency change is used, the swept-frequency sonication may be conducted by continuously varying the frequency up and down the range or by varying it in one direction and then repeating the cycle. This method is simple to apply as it does not require the upfront knowledge of exact values of resonance frequencies, just their general estimated values. Such estimated values can be derived from the characteristic dimension of the resonator cell and the approximate speed of sound propagation in the sample liquid. For that reason, in many cases this method is sufficient to achieve adequate stirring without the need for complicated means to determine the exact values of resonance frequencies.

Alternatively, the resonance frequency may be first detected by the system using means described in more detail below. When using a variable rate of changing frequencies of the transducer, it may be advantageous to use lower rate of frequency change in the vicinity of the resonance frequencies and higher rate of frequency in between these resonance frequencies. That way, the nodal patterns are retained for longer periods of time and are achieved faster than in the case of a constant rate of frequency change.

In a stepwise sweep of the frequencies, the liquid sonication is performed by driving the transducer only at or close to the detected resonance frequencies of the resonator cell. When driven at a first selected resonance frequency of the resonator cell, the transducer generates a first ultrasound standing wave and forms a first nodal pattern throughout the resonator cell. The term "first resonance frequency" should not be confused with the first harmonic of the resonator cell. For the purposes of this description, the "first resonance frequency" is the one initially selected from a number of resonance frequencies available between the predefined minimum frequency and a predefined maximum frequency, all such resonance frequencies causing resonance in the liquid contained in the resonator cell and are associated with formation of a corresponding standing wave.

Upon achieving the resonance at a first resonance frequency, the ultrasound radiation force urges the microparticles to move towards a first plurality of potential energy minima locations within the first nodal pattern of the standing wave field. The frequency of the ultrasound transducer is then changed by the control system from the first resonance frequency to the second resonance frequency. That in turn destroys the first nodal pattern of standing waves and creates a second nodal pattern corresponding to this second resonance frequency of the standing wave. Importantly, the locations and the number of the second plurality of potential energy minima locations defined by the second nodal pattern where particles tend to accumulate are substantially different from that of the first plurality. The disappearance of the first nodal pattern and the appearance of the second nodal pattern in different locations urge the microparticles to abandon their first plurality of locations and move to the second plurality of locations. The second resonance frequency is activated preferably for the time at least long enough to cause the microparticles to move substantially to the second plurality of locations corresponding to the second nodal pattern. Typically the time needed to rearrange the microparticles is in the millisecond range. After enough time has passed to allow the microparticles to move substantially to the second plurality of locations, the control system again switches the frequency of the ultrasound transducer to yet another resonance frequency, such as the first resonance frequency or another resonance frequency. Such frequency change again destroys the second nodal pattern and creates a different nodal pattern and therefore urges the microparticles to move from the second plurality of locations to the new plurality of locations. The process of changing frequencies of the ultrasound transducer continues further as defined by the control system and so is the process of urging the microparticles to move from a current plurality of locations to the new plurality of locations. Vigorous continued movements of the microparticles throughout the resonator cell causes intense mixing and stirring of the liquid or liquids contained therein.

In its most basic form, the device of the invention includes a resonator cell having at least one liquid or a mixture of two or more liquids. Also containing in the resonator cell is a suspension of at least one type of microparticles. Other essential elements of the device of the invention are the ultrasonic transducer acoustically coupled to the resonator cell and a control system capable of activating the transducer in a range of frequencies selected to include at least two resonance frequencies of the liquid contained in the resonator cell. The control system is adapted to drive the transducer at a frequency varying within a predefined range reaching at least two resonance frequencies or in a broader case many resonance frequencies of the liquid along the way.

Importantly, the transducer should be selected to be a broadband ultrasound transducer so that driving it at frequencies other than its own resonance frequency provides enough energy output into the resonator cell. The swept-frequency range should be selected to be preferably outside but not too far away from the resonance frequency of the transducer as doing so may impede on the power output capability of the transducer. More sophisticated designs of the apparatus of the invention including variations of the control system and resonator cell are described below in greater detail.

The invention discloses a concept for stirring and mixing liquids in microfluidic devices that may be advantageously used for many useful applications including for example drug screening, genetic analysis, medical diagnostics, chemical synthesis, environmental monitoring as well as in biochemical sensing techniques such as immunoassays and hybridization analyses, all such fields which require rapid, homogeneous mixing of liquids including solutions of macromolecules, such as DNA or proteins.

In general, the invention can be used for enhancement of any physical and chemical process in liquids. The invention is also applicable for the processes occurring at the interface between a solid surface and a liquid when the effectiveness of these processes depends on diffusion rate. Examples of processes that can be enhanced by increasing diffusion rate include various chemical and biochemical reactions such as the polymerase chain reaction (PCR), binding of a substrate and a ligand, hybridization of nucleic acids and their fragments, interaction between antigen and antibody, etc.

Other processes which can be enhanced by improved diffusion with the use of microparticles according to this invention also include extracting, separating and sterilizing.

A further process that can be improved by the invention is thermostating, which is commonly used in numerous processing technologies. Enhanced convection caused by ultrasonically induced rapid motion of suspended microparticles in the thermostated liquid will speed up the temperature equilibration in the treatment vessel.

Also in accordance with the present invention, there is provided an apparatus for stirring and mixing liquids, comprising at least one ultrasonic transducer acoustically coupled with the resonator cell. The transducer is selected to have a frequency bandwidth broad enough to generate several resonance frequencies in the treated liquid. Also included is an electronic unit which generates a driving signal for the transducer at a frequency in the above mentioned range.

The preferred frequency range employed for stirring liquids with suspended microparticles using sweep-frequency mode of sonication is about 0.5-50 MHz, and the most preferred range is from about 1 to about 30 MHz. These ranges are defined by several factors. One factor is that it is difficult to rapidly move the microparticles from one nodal position to another if the distances between these nodes are significantly more than 1 mm. Another factor is that in the applications of the present invention, characteristic dimensions of the resonator cells containing the liquids that need to be stirred are typically in the range from about 0.1 mm to about 10 mm. Yet another factor is that at high frequencies, attenuation of ultrasound is greatly increased, so much so in some cases that there is not enough intensity of reflected wave to generate standing waves. The attenuation in water and aqueous solutions is approximately proportional to the square of the ultrasound frequency. Yet another factor is that to obtain a standing wave in the liquid, the dimensions of the vessel containing that liquid should be from about half the wavelength of ultrasound to about tens of wavelength of ultrasound. The above mentioned choices of frequency range are made considering a compromise of these factors. In these ranges of frequency, the wavelength of ultrasound in aqueous solutions will be from about 3 mm down to about 30 mkm.

For some embodiments of the invention, the resonator may include two plane-parallel surfaces that have high acoustic reflectivity. Such embodiments can be implemented, for example, in the design of small volume spectrophotometer cell, in which stirring and mixing of liquid sample could be required.

For other embodiments of the invention, the resonator cell can be formed between the bottom of the sample container and the open surface of the sonicated liquid.

In yet other embodiments of the invention, the sample container can be a microtiter plate, a microtiter well, a test tube, a centrifuge tube, an ampoule, or any other similar form of vessel having ultrasound reflecting boundaries necessary for obtaining a pattern of standing wave nodes in the liquid filling the vessel. A particularly useful example of advantageous use of the invention with microtiter plates is for the enzyme-linked immunosorbent assay (ELISA).

Further advantageous embodiments of the invention include devices for mixing two or more liquids together using magnetic microbeads. Such microbeads are retained in the resonator chamber while constantly shifting their position so that incoming liquids are mixed together. After completion of the stirring and mixing procedure the magnetic microbeads can be conveniently collected by an electromagnet and removed from the liquid.

Yet further advantageous use of the invention is with microarrays to allow faster movement of the test liquid over the microarray plate and improving the rate of interaction of the target molecules in the test liquid with the surface of the microarray.

The invention may be implemented using a wide variety of different microparticles with diameter ranging from about 0.1 to about 100 micrometers. Examples of such microparticles include latex beads, magnetic microbeads, emulsion microdroplets, and microbubbles formed by various gases.

The term "microparticles" is used here to also include microbubbles as described below. One example of such microbubbles is simple gas bubbles, which disappear in less than a minute after introduction into a liquid sample. Another example of microbubbles includes encapsulated gases, such as used as ultrasound contrast agents. U.S. Pat. No. 4,718,433 and U.S. Pat. No. 6,110,444 disclose particularly useful preparations of ultrasound contrast agents made of gas microbubbles stabilized by encapsulation with a wall-forming material. The wall-forming material could be a thermally denatured protein, a surfactant, a lipid, polysaccharide and other membrane forming substances. Microbubbles can further be generated by adding gas-generating material, such as microemulsions, which undergo a phase-change from liquid droplets to dispersed gaseous microbubbles under the action of ultrasound, as disclosed in the U.S. Pat. Nos. 5,840,276 and 6,569,404. Vaporization can be achieved by the application of single ultrasonic tone burst as described by Kripfgans O D et al., On the acoustic vaporization of micrometer-sized droplets. Acoust Soc Am. (2004) 116(1), 272-81. For certain useful embodiments of the invention based on using microbubbles obtained by ultrasonic vaporization of microdroplets, a treatment process for sample stirring is performed in two steps: first, a sample is treated with an ultrasound pulse at a relatively high intensity in order to vaporize the liquid droplets, and than the sample is stirred by a swept-frequency mode of sonication at a lower level of ultrasound intensity.

BRIEF DESCRIPTION OF THE DRAWINGS

A more complete appreciation of the subject matter of the present invention and the various advantages thereof can be realized by reference to the following detailed description in which reference is made to the accompanying drawings in which.

DESCRIPTION OF THE PREFERRED EMBODIMENTS OF THE INVENTION

A detailed description of the present invention follows with reference to accompanying drawings in which like elements are indicated by like reference letters and numerals.

Figure 1A:
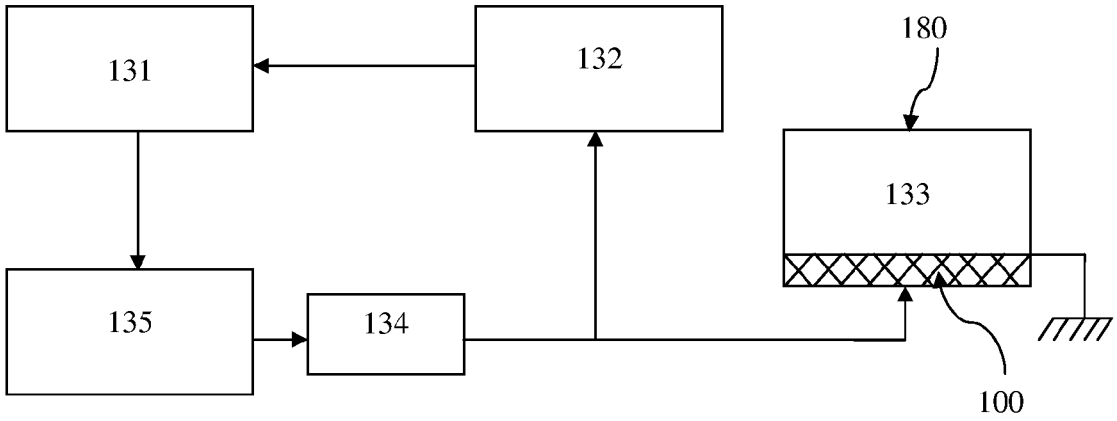
FIGS. 1A through 1C represent block-diagrams of devices according to the first embodiment of the invention.

Referring to FIG. 1A, there is shown a block-diagram of the device according to the first embodiment of the invention. The device includes a transducer 100 that generates ultrasonic standing waves at various harmonics in the liquid filling the resonator cell 133. The resonator cell 133 can be formed between the liquid-contacting surface of the transducer 100 and a plane-parallel acoustic reflector 180 located opposite the transducer 100 so that ultrasonic wave may travel back and forth forming standing waves at certain resonance frequencies of the liquid column above the transducer. The transducer 100 is typically a disc, plate or a film made of piezoceramics, piezopolymer, or other material that can generate acoustic waves under alternating current excitation. The resonator cell 133 could be also formed by a vessel of arbitrary internal shape as long as its walls provide effective reflection of acoustic waves, creating at certain frequencies the nodes of standing waves in the liquid filling the vessel at various locations throughout that vessel. Reflection of acoustic waves necessary for generation of standing acoustic waves can also occur from an open surface of a liquid filling the resonator cell. The open surface therefore constitutes one useful example of the acoustic reflector 180.

Microparticles are present and suspended in the liquid filling the resonator cell 133. When these particles are subjected to an acoustic standing wave field, they are displaced to the location of the standing wave nodes. Sweeping the frequency of the alternating current signal driving the transducer 100 results in successive appearance of various patterns of standing waves and varying position of standing wave nodes. Correspondingly, suspended microparticles are forced to move from one location of the nodes to another following the movement of the nodes throughout the cell, acting therefore as effective microstirrer of the liquid.

The control system of the first embodiment is now described in more detail. Transducer excitation alternating current signal is preferably generated by a voltage controlled oscillator (VCO) 135. A microprocessor 131 is used to generate a sweep of voltage which is sent out to VCO 135. Corresponding to the voltage sweep, the VCO 135 provides sweep of frequency of the alternating current electrical signal. The output of the VCO 135 is sent to the ultrasound transducer 100 via a complex resistor 134. The complex resistor 134 acts as a voltage divider and splits the electrical signal proportionally so that it could be utilized for detecting changes of the impedance of the transducer 100 acoustically loaded by the ultrasonic resonator cell 133.

The exact information about resonance frequencies of the liquid filled resonator cell may not be available at the beginning of operation of the device since these frequencies are defined by the speed of sound in the liquid filling the resonator cell. This speed depends on the composition and temperature of the liquid filling the resonator cell and these parameters can vary from experiment to experiment. Therefore the control system is made capable to automatically detect these resonance frequencies by measuring changes of electrical impedance of the transducer 100. When a standing wave is established in the liquid filling the resonator cell, the acoustical loading of the transducer 100 changes, thus affecting its electrical impedance. Every time when the driving frequency of the transducer 100 is approaching the resonance frequency of the liquid-filled resonator cell, the amplitude and the phase of the signal at the output of the complex resistor 134 significantly changes. These changes are detected by the amplitude and/or phase detector 132 and sent back to the microprocessor 131 indicating the appearance of standing waves at certain resonance frequencies.

Although as stated above, exact resonance frequencies of the liquid in the resonator cell may not be known at the beginning of the operation of the device, their approximate values can be estimated knowing the general geometry of the resonator cell. It is useful to select the minimum and the maximum frequency of the initial sweep to cover at least two and preferably several harmonics of the resonator cell. At the same time, it may be best to not include the resonance frequency of the transducer in this range, which may cause uneven levels of ultrasound intensity in the successive standing wave patterns in the swept-frequency mode of sonication.

A particular set of detected resonance frequency values along the entire sweep obtained by the microprocessor 131 during the initial sweep is of prime importance to the current invention. Depending on the type and size of particles, the microprocessor 131 is adapted to use different programs and algorithms for continuous (with constant or variable rate of frequency change) or step-wise frequency sweep utilizing information on particular resonance frequencies at which standing waves are formed.

A further improvement of the invention includes repeating from time to time the diagnostic sweep of frequencies to refresh the current values for the set of resonance frequencies as well as to determine if the new set has deviated from the previously recorded values of resonance frequencies. Detecting a change in the amplitude and/phase of the signal obtained by the detector 132 indicates the presence of changes in the resonator cell, such as a temperature increase, which affected the position of the resonance frequencies.

If stepwise sonication is used, such change when exceeding a predetermined threshold value, triggers initiation of a new diagnostic frequency sweep to occur to refresh the values of the resonance frequencies of the resonator cell previously recorded by the microprocessor 131. This sweep, controlled by the microprocessor 131, may be conducted either through entire frequency range covering all resonances used for treatment of a liquid in a particular application, or, preferably, only in the vicinity of the resonance frequencies obtained during the initial sweep. Since the microprocessor 131 is adapted to continuously monitor the resonance frequencies using the driving signal provided by detector 132, any shift of the resonance frequency is detected at an early stage. This means that only small corrections of the recorded values of the resonance frequencies are needed and there is no need to repeat a complete diagnostic sweep such as the one conducted at the beginning of the procedure. Making small local sweeps in the vicinity of the maxima of the previously recorded resonance peaks is sufficient to maintain effective operation of the device.

These repeated sweeps allow to accurately maintain the standing wave condition in the stepwise mode of sonication of liquid and do not affect the procedure of liquid treatment because they take negligible time. The time for each such adjustment sweep is on the order of a millisecond while the typical times needed for the sonication procedure is on the order of seconds and minutes. These repeated sweeps provide automatic detection and control of the standing wave condition in the resonator cell independent of variations of temperature. The magnitude and/or timing of adjustments that need to be made to maintain the resonance conditions in the liquid filling the resonator can be used as a quantitative measure characterizing changes in the liquid, such as temperature increase. Monitoring of temperature of the sample liquid using the above described method is useful in optimizing the ultrasound exposure and avoiding unnecessary heating of the sample.

In a continuous mode of swept-frequency sonication, there is no need to repeat the diagnostic sweep as all frequencies are covered anyway by the range of the sweep. However, even in that case, it is useful to monitor the values of resonance frequencies as their deviations indicate the changes in the liquid conditions. Excessive heating of the liquid may therefore be avoided when increase in temperature is detected early enough by automatic adjustment of the ultrasound intensity.

Figure 1B:
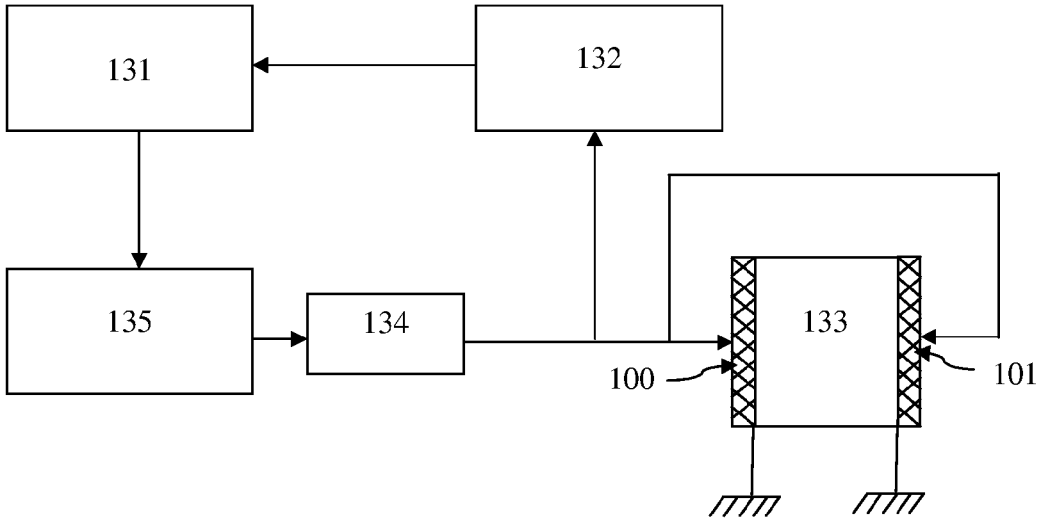

FIG. 1B shows a schematic block-diagram of a variation of the device illustrated in FIG. 1A, which differs only in configuration of the resonator cell. Instead of one transducer and one reflector necessary for generating a standing wave in the sonicated liquid, the device of FIG. 1B uses two plane-parallel transducers 100 and 101, connected in parallel, which allows delivering more acoustic energy into the resonator in case it is necessary. In the device according to this embodiment, the transducers 100 and 101 are driven by an electronic circuit identical to that shown in FIG. 1A.

Figure 1C:
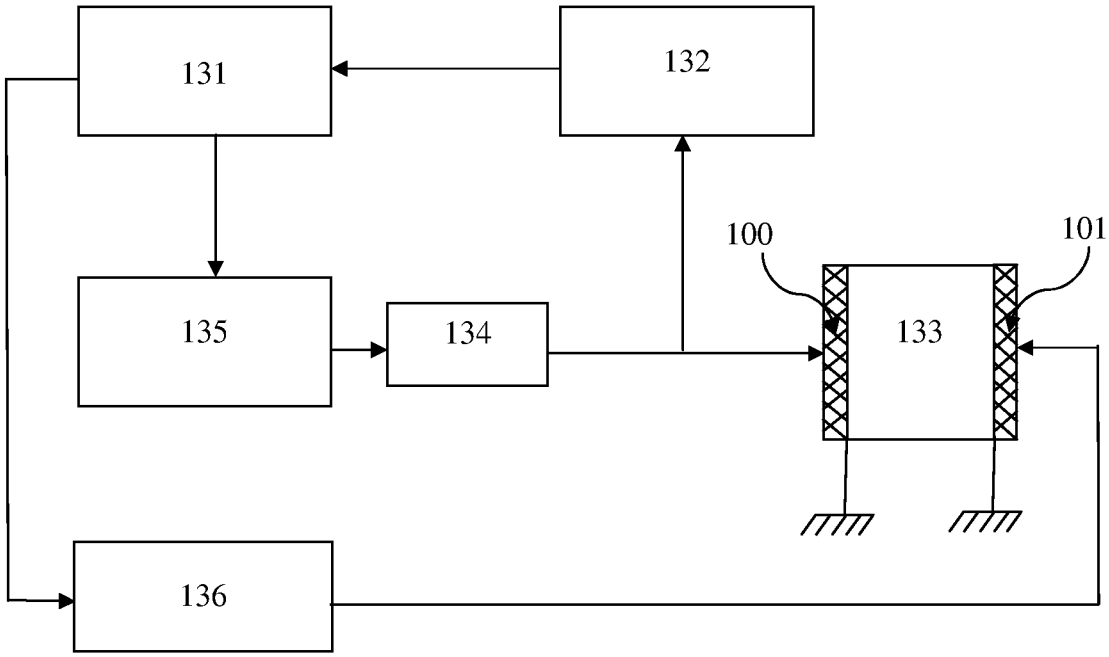

FIG. 1C shows yet another embodiment of the invention shown in general on FIG. 1B, which also uses a transducer 100 and a plane-parallel transducer 101 but each of these two transducers is driven individually by a dedicated voltage-controlled oscillator (VCO) 135 and 136 each VCO being controlled by the microprocessor 131. The frequency and phase of the signal generated by the VCO 136 driving the transducer 101 could be the same or preferably oscillating back and forth about that generated by the VCO 135 and applied to the transducer 100. As described above, the feedback circuit consisting of the complex resistor 134 and phase and amplitude detector 132 provides for automatic monitoring of required mode of the frequency sweep of the signal applied to the transducer 100. At the same time, the variation of the frequency or amplitude of the signal applied to the transducer 101 provides for a possibility to slightly shift or to oscillate in space the locations of nodal patterns of the standing wave. This shift of locations within the same nodal pattern may be useful so as to increase the efficacy of stirring when a stepwise sonication method is applied at a lower rate of switching between resonance frequencies.

Figure 2:
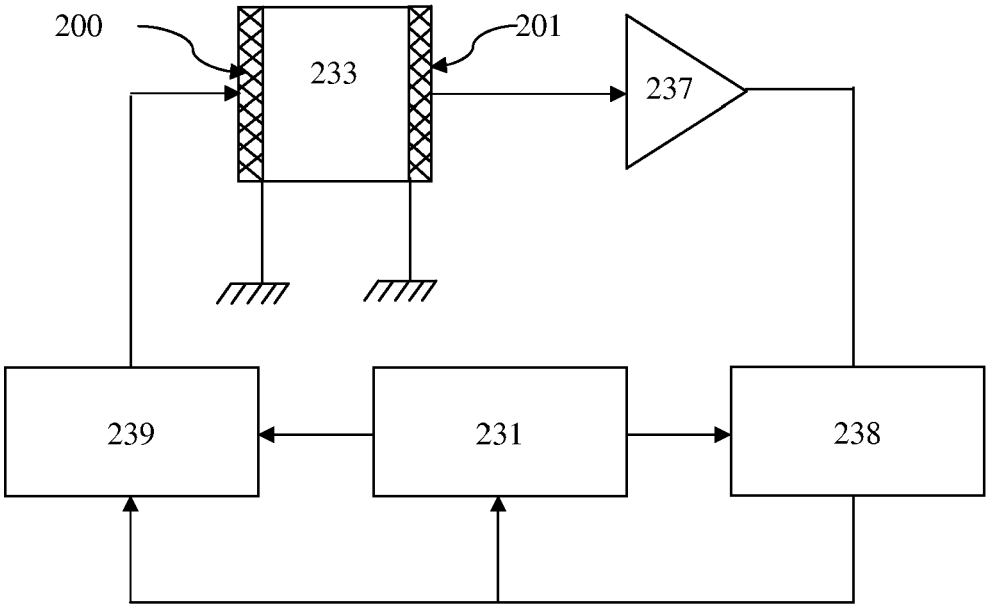
FIG. 2 is a block-diagram of the device according to the second embodiment of the invention.
Figure 3:
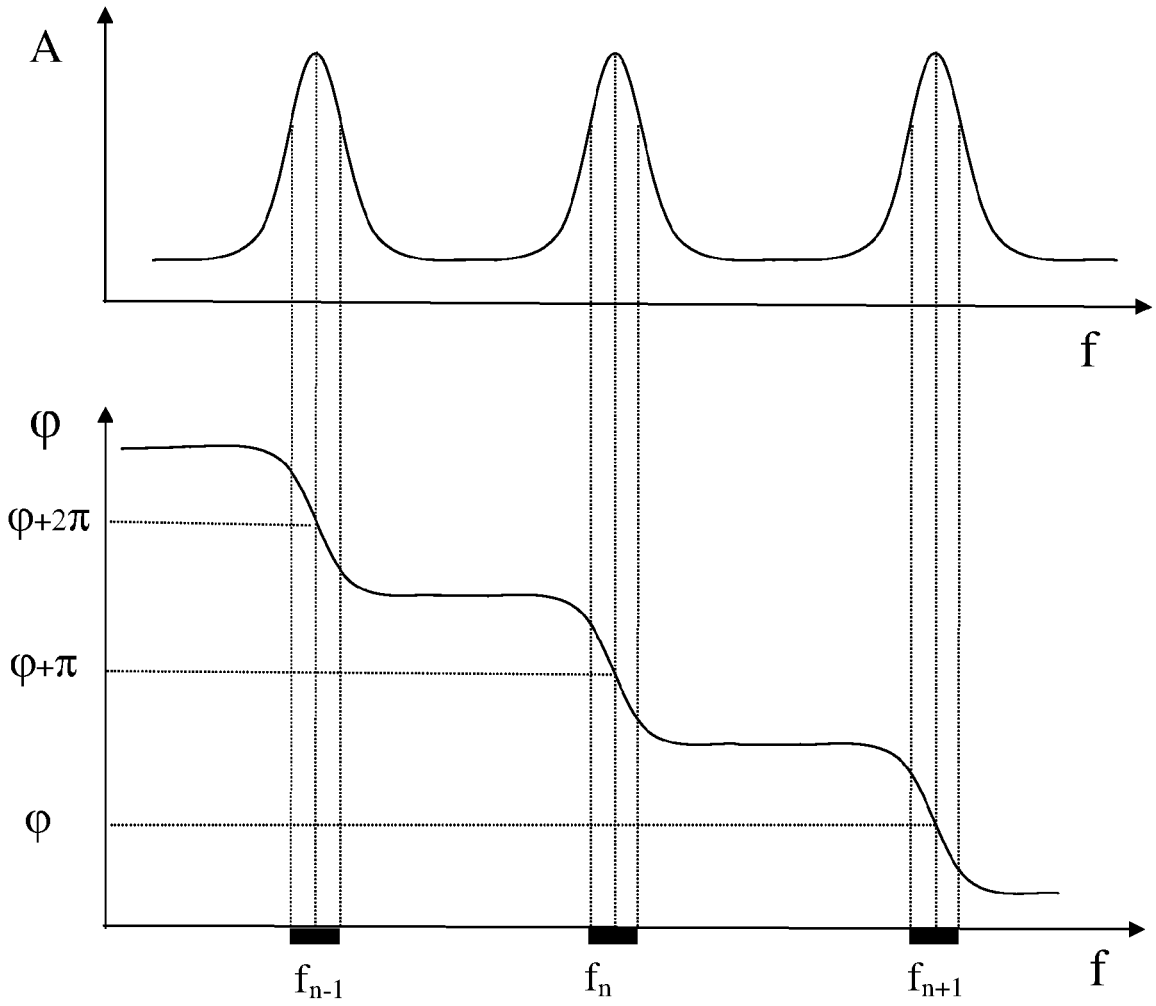
FIG. 3 shows frequency dependencies of amplitude and phase of the signal at the output of the resonator shown on FIG. 2.

FIG. 2 shows a schematic block-diagram of the second embodiment of the invention. In the device according to this embodiment of the invention, an ultrasonic resonator cell 233 is formed by two plane-parallel piezotransducers 200 and 201 and is connected to a simple oscillation and feedback control system, including a broadband amplifier 237, a phase-locked loop chip 238, a microprocessor 231 and a bandpass filter 239. The transducer 201 serves both as a reflector and a receiver of ultrasound. FIG. 3 shows frequency dependencies of amplitude and phase of the signal at the receiving transducer 201 in a frequency band covering several resonance harmonics $f_{n-1}$, $f_n$, and $f_{n+-1}$. The phase of the signal from the receiving transducer 201 is changed by 180° when the frequency is swept through a region corresponding to a resonance peak marked by bold lines on the frequency axis of the graph of FIG. 3. As seen in FIG. 3, the inflection point of the phase/frequency curve corresponds to the maximum of the resonance peak that is optimum frequency for generating a standing wave in the resonator cell.

Maintaining phase relationships between transmitted and received signals close to the value corresponding to the inflection point of the phase characteristics provides necessary conditions for generation of standing wave. The phase-locked loop (PLL) chip 238 is adapted to automatically maintain the resonance phase relationship between the input and output signals of the resonator cell 233 by changing the oscillation frequency. The circuit maintains the appropriate phase relationship despite variations in temperature or other conditions that alter the sound velocity, and therefore the resonance wavelength in the liquid. The resonator cell 233 functions as the frequency-determining element of the oscillator. Constraining the oscillator to operate in the specific frequency region by adjusting the bandpass of the amplifier 237 allows one to generate a standing wave corresponding to the chosen harmonic of the resonator.

To sweep the frequency, that is to move from one harmonic of the resonance to another, the microprocessor 231 is varying the voltages controlling either the setting of the bandpass filter 239 or the setting of the phase of the PLL circuit 238.

Figure 4:
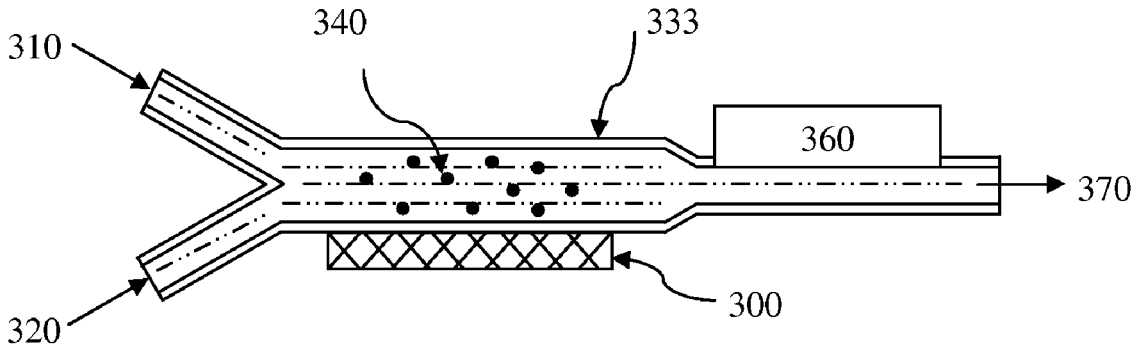
FIG. 4 is a sectional view of a flow-through device for mixing two liquids using magnetic microbeads according to the third embodiment of the invention.

FIG. 4 illustrates an implementation of the resonator cell according to the third embodiment of the invention. This design is particularly useful to facilitate mixing of two or more liquids using magnetic microbeads in a flow-through device for microfluidic applications. In the illustrated arrangement, the two liquids being mixed are supplied from different inlets 310 and 320 leading into a resonator cell 333. Some magnetic microbeads 340 are also fed into the resonator cell 333 along with the mixing liquids. Magnetic microbeads, such as for example micron-scale particles, are used in a variety of biotechnology applications, most notably for cell sorting and assay separations [as described in Choi, J.-W., C. H. Ahn, S. Bhansali, and H. T. Henderson. A new magnetic bead-based, filterless bio-separator with planar electromagnet surfaces for integrated bio-detection systems. Sens. Actuators B Chem. 2000, 68:34-39]. Magnetic microbeads are commercially available from numerous commercial sources and are commonly composed of iron oxide nanocrystals embedded within a spherical polystyrene matrix.

As shown on FIG. 4, there is provided a transducer 300 mounted at the bottom of the resonator cell 333, which generates different harmonics of standing acoustic wave in the liquid in the resonator cell 333. In the presence of acoustic standing waves, magnetic microbeads 340 are captured and retained in the nodes of standing wave field so as not to be carried out by the flowing liquid. The changing nodal pattern of standing acoustic waves forces suspended magnetic microbeads 340 to jump from one position to another efficiently stirring and mixing the liquid flowing through the resonator cell 333. Once the procedure is complete, the ultrasound is switched off and the magnetic microbeads are washed out of the resonator cell 333. On their way out, the microbeads 340 are captured by an electromagnet 360 inserted in the system at the outlet 370 of the resonator cell. Finally, the electromagnet 360 is detached from the system and turned off so that magnetic microbeads 340 can be separated from the electromagnet 360 and reused.

Other adaptations of this embodiment include providing more than two inlets to mix together more than two liquids at the same time as well as employing mixing blades and other channeling features generally known to encourage mixing of liquids.

Figure 5:
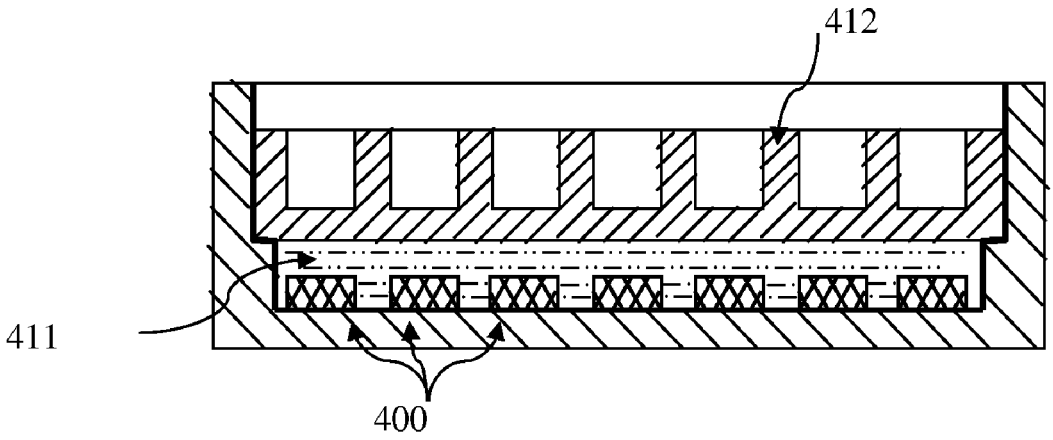
FIG. 5 is a sectional view of a fourth embodiment of the present invention used for stirring samples in the wells of a microtiter plate.

FIG. 5 illustrates a fourth embodiment of the invention having a resonator cell designed for stirring liquid samples in the wells of a microtiter plate. Microtiter plates and wells are a standard tool in analytical research and clinical diagnostic testing laboratories. A very common usage of these plates is in the enzyme-linked immunosorbent assay (ELISA). A microtiter plate is typically arranged as a rectangular matrix with tens and even hundreds of wells. Each well of a microtiter plate typically holds from a few to a few hundred microliters of liquid. Stirring is required for mixing of liquids and compound dissolution. It is an important step in nearly all applications of microtiter plates, including ELISA and a variety of other immunoassays as well as in high throughput screening applications. Simultaneous stirring of multiple small samples using conventional means would be prohibitively difficult due to their complexity and cost constraints. The present invention allows stirring of all wells of a plate at the same time. In the exemplary design of the apparatus illustrated in FIG. 5, an array of transducers 400 is placed near the bottom of the microtiter plate 412 so that every well of the microtiter plate is individually subjected to the continuous swept-frequency mode of sonication. The arrangement of transducers 400 is such that it matches the geometry of the wells in the microtiter plate 412. Transducers are connected in parallel and activated by one of the control systems as described above (not shown on FIG. 5). The space 411 between the plate 412 and transducers 400 is filled with water or another appropriate acoustic coupling medium. A small amount of microbeads made of inert material, such as latex microspheres for example, is added to the samples when they are injected in the wells of the microtiter plate 412. Since the interface between the surface of the liquid sample and air acts as a reflector of acoustic waves, sonication of the wells in the swept frequency mode by the transducers generates at certain resonance frequencies standing waves with varying nodal pattern causing rapid motion of the microbeads throughout the sample resulting in the mixing and stirring of the sample.

Figure 6:
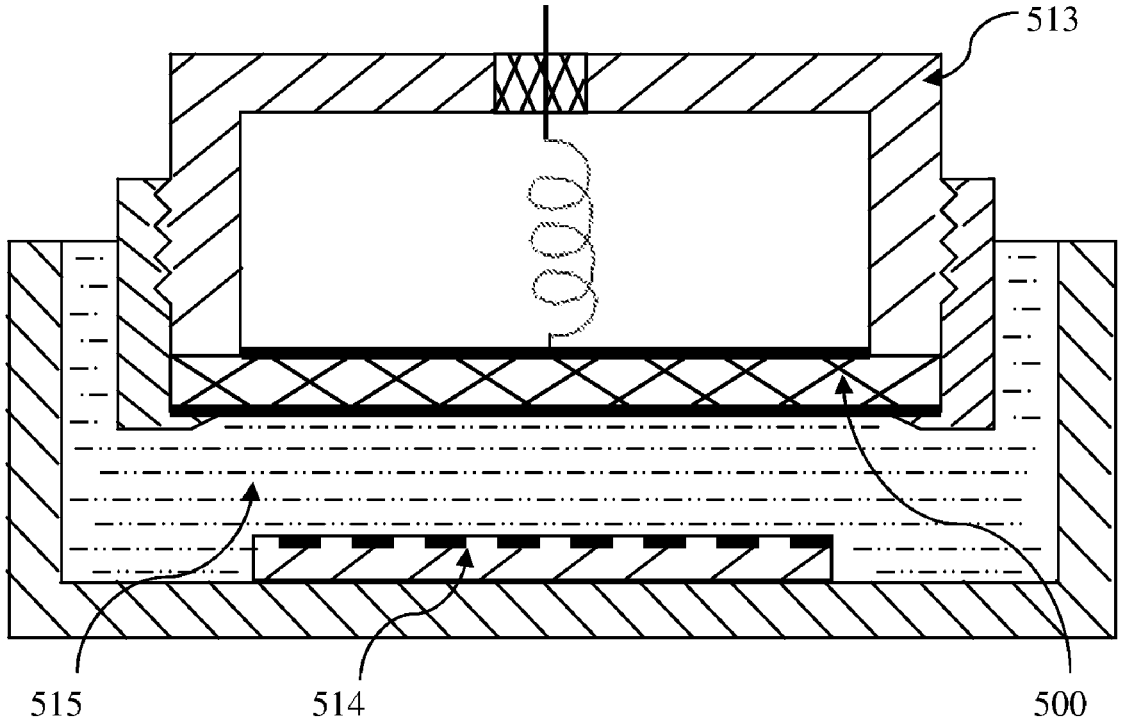
FIG. 6 is a sectional view of a fifth embodiment of the present invention for stirring samples over a microarray plate.

FIG. 6 illustrates the fifth embodiment of the invention having a resonator cell designed for improving the performance of various microarrays. Microarrays are widely used for identification of proteins, oligonucleotides, and other biologically important molecules. Microarray analysis became the basis for the recent advances in high-throughput technologies for studying genes and their function. The basic structure of a microarray is simple: a glass slide or membrane is spotted or "arrayed" with various molecules, such as DNA fragments or oligonucleotides that represent specific gene coding regions. One of the drawbacks of a microarray analysis is long time of testing, which could be in the range of hours. Effective microstirring of the sample tested by the microarray analysis will reduce diffusion limitation and may significantly improve the performance of the microarray method. Such microstirring necessary for speeding up the microarray analysis can be provided by the current invention. A small amount of microparticles is added to the test sample. Applying of the ultrasonic waves to the sample by swept-frequency mode of ultrasound to generate varying nodal pattern of standing acoustic waves will greatly increase the rate of molecular processes involved in microarray analysis. FIG. 6 schematically shows a fifth embodiment of the present invention for stirring samples over a microarray plate 514. An air-backed piezotransducer 500 mounted in a housing 513 is placed parallel to the microarray plate 514 forming a resonator cell necessary for generating standing waves in the tested fluid 515. The transducer is energized by the control system not shown in the drawings but similar to the previous embodiments of the invention using continuous swept-frequency mode of sonication.

Types of microparticles that can be used for stirring and mixing liquids include not only solids microbeads such as latex microspheres or magnetic microbeads mentioned above, but also liquid microparticles such as formed from a small amount of emulsion with microdroplets of an immiscible liquid. Another type of liquid microparticles that can be very efficiently manipulated by varying nodal pattern of standing acoustic field is gaseous microbubbles. Microparticles bases on microbubbles include simple gas bubbles, which disappear in less than a minute after introduction into a liquid sample, as well as encapsulated gases, such as for example ultrasound contrast agents, which could stay intact longer after injection in the sample. U.S. Pat. No. 4,718,433 and U.S. Pat. No. 6,110,444 disclose as one useful example the preparation of ultrasound contrast agent made of gas microbubbles stabilized by encapsulation with a wall-forming material. The wall-forming material could be a thermally denatured protein, a surfactant, a lipid, polysaccharide and other membrane forming substances. Microbubbles in the sample can also be generated by adding gas-generating material, such as microemulsions, which undergo a phase change from liquid droplets to dispersed gaseous microbubbles under the action of ultrasound, as disclosed in the U.S. Pat. Nos. 5,840,276 and 6,569,404. Vaporization of liquid-filled droplets can be achieved by the application of single ultrasonic tone burst (Kripfgans O D et al., On the acoustic vaporization of micrometer-sized droplets. Acoust Soc Am. (2004) 116(1), 272-81).

Figure 7A:
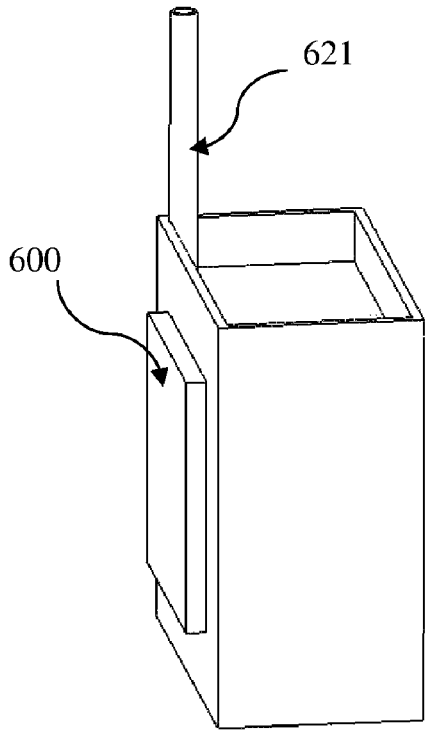
FIGS. 7A and 7B show isometric and sectional views of a spectrophotometer cell of the sixth embodiment of the invention where ultrasonic stirring of liquid is performed using injected microbubbles.
Figure 7B:
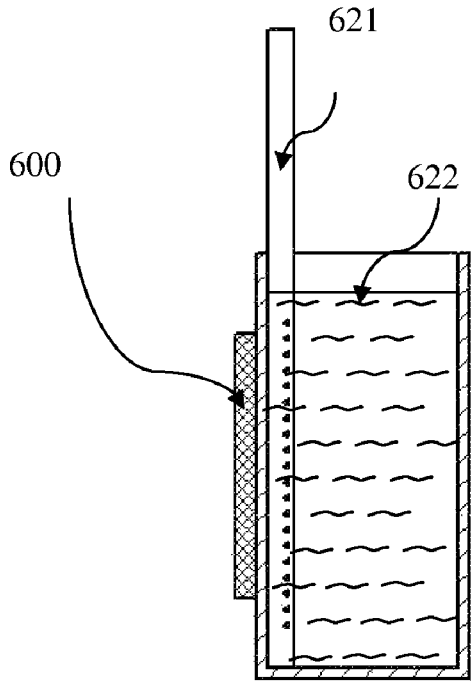

An exemplary design of the sixth embodiment of the invention where the resonator cell is adapted for using gaseous microbubbles is shown in FIG. 7. FIGS. 7A and 7B show isometric and sectional views of a spectrophotometer cell where ultrasonic stirring of liquid is performed using injected microbubbles.

Spectrophotometer cells typically are not equipped with any mixing means or with any magnetic stirring mechanism. Titrations frequently require removal of the cell from the instrument to achieve good mixing. The magnetic stirring is effective only in large volume spectrophotometer cells in which the motion of the stir bar can be accommodated. In the small cells only the lower portion of the liquid is stirred adequately. One known alternative mixing means employs a small filament inserted into the sample and rotated by a small motor to stir the sample. This does not work very well with small volumes of liquids due to possible partial occlusion of the light beam through the sample.

The stirring based on this invention with the use of small amounts of injected gaseous microbubbles provides effective mixing of liquids in the spectrophotometer cells. The microbubbles are introduced into the sample liquid 622 with the help of a capillary injector 621 having small diameter holes along its length. A transducer 600 provides swept-frequency stirring in a manner similar to that described above. The control system is not shown on this drawing. After a few seconds of stirring of the spectrophotometer cell content, the microbubbles disappear from the solution, preferably by dissolving therein. The amount of microbubbles injected into the small volume of sample liquid 622 should not in that case exceed the level allowing full solubility of the injected microbubbles, preferably in the time frame ranging from a few seconds to about a minute.

An important aspect of the invention is the choice of parameters of ultrasonic transducers. Ideally, the swept-frequency mode of sonication requires a broadband source of ultrasound so that a significant number of various successive resonance frequencies of the liquid-filled resonator cell have close energetic parameters. This requirement is in general difficult to satisfy since the commonly available piezoceramic transducers have a narrow operating frequency band corresponding to their own natural resonance frequency. However, since the invention does not require high levels of ultrasound intensity similar to those needed to produce cavitational or thermal effects in various biomedical and industrial applications of ultrasound, it is possible to operate these transducers in the frequency range not too close to the natural resonance frequency of the transducer.

Figure 8:
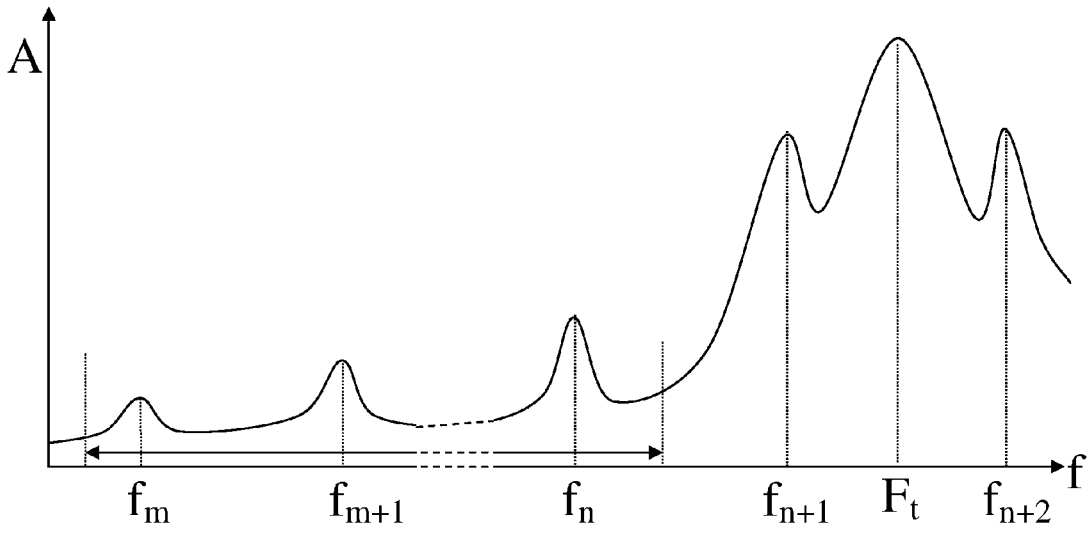
FIG. 8 shows amplitude/frequency dependence of ultrasonic resonator in the presence of standing waves in the liquid filling the resonator; and finally FIG. 9 schematically illustrates the seventh embodiment of the invention showing the process of stirring a sample liquid in a spectrophotometer cell using ultrasonic vaporization of microdroplets.

FIG. 8 shows a typical amplitude/frequency dependence of an ultrasonic resonator cell in the presence of standing waves. The horizontal solid arrow denotes a frequency region, which includes several harmonics in the sample, from $f_m$ to $f_n$, and which is appropriate for swept-frequency mode of sample liquid sonication according the current invention. The working frequency range should preferably not include the resonance frequency $F_t$ and higher harmonics of the transducer.

Since working at the frequencies far from the natural resonances of the transducer limits the levels of acoustic energy that can be generated in the sample. Therefore in certain applications, it might be necessary to take measures helping to get more energy from the transducer such as providing special acoustic matching layer bonded onto the surface of the transducer and optimal matching of the output parameters of the driving electronic circuit with the electromechanical parameters of the transducer.

Although in all the described above applications of the invention the frequency region of the transducer's own resonance is suggested to be avoided in the swept-frequency mode of sonication, there is one application where high intensity ultrasonic pulses generated at or near the resonance frequency of the transducer needs to be employed as well. This application constitutes the seventh embodiment of the invention and is related to microparticle-based stirring with the use of microbubbles obtained by ultrasonic vaporization of microdroplets. In this application, a process of sample stirring is performed in two steps: first, the sample is treated with an ultrasound pulse at a relatively high intensity obtained at the natural resonance frequency of the transducer in order to vaporize the liquid droplets, and than the sample is stirred by a swept-frequency mode of sonication at a lower level of ultrasound intensity at frequencies away from the natural resonance frequency of the transducer.

Figure 9:
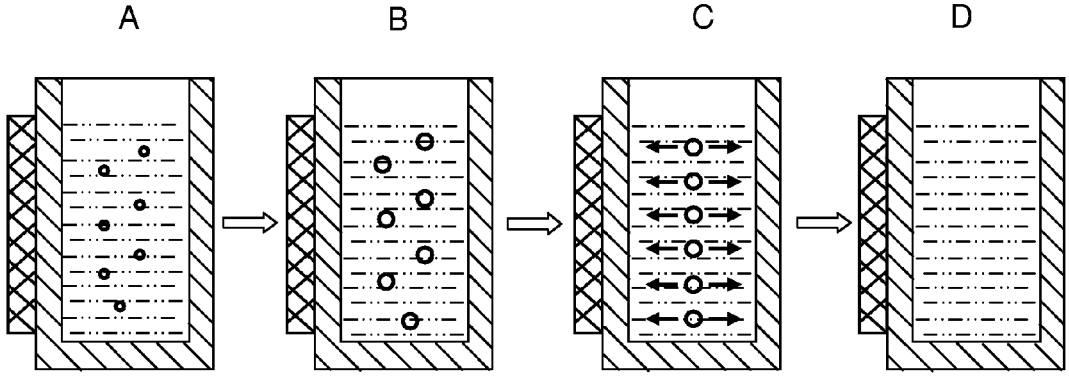

FIG. 9 shows an example of such application and a seventh embodiment of the invention. Similarly to FIG. 7, it illustrates a microparticle-based stirring of a sample in the spectrophotometer cell. Panel A of FIG. 9 shows a spectrophotometer cell filled with a test liquid mixture, which needs to be stirred before conducting an optical measurement. The transducer is attached to one side of the cell (on the left as shown on the drawing) and the cell acts as an acoustic resonator where various modes of standing waves can be generated. A small amount of microemulsion is added to the sample. Microemulsion may preferably contain micrometer-sized perfluorocarbon droplets, which can be easily vaporized by a single tone burst of low MHz range ultrasound (Kripfgans O D et al., On the acoustic vaporization of micrometer-sized droplets. Acoust Soc Am. (2004) 116(1), 272-81). Panel B of FIG. 9 shows the spectrophotometer cell after microdroplet vaporization by high intensity ultrasound, that is a phase transition of the microdroplet into a gaseous microbubble shown on the drawing as larger size circles. Panel C schematically illustrates the next step of the sample treatment: stirring the liquid filling the cell by moving the microdroplets captured in the nodal planes of standing waves in the swept-frequency mode of sonication by the same transducer. Panel D of FIG. 9 shows the final stage of the process when all the microbubbles are dissolved in the liquid filling the cell after serving their purpose to stir and mix the sample. Since the volume fraction of the gaseous microdroplets is very small compared to the sample, and the gas is chemically inert, the dissolving of microbubbles does not affect the composition and the optical properties of the mixture.

Of course, while it is convenient to use the same transducer for both the vaporization of microdroplets and stirring the sample thereafter, other variations of the invention are contemplated having separate ultrasonic transducers adapted to separately perform each individual step of the process as described above.

Such technique of two-step stirring of liquids illustrated in FIG. 9 by first vaporizing of the added microemulsion using high intensity short pulse of ultrasound and then using the swept-frequency mode of the generated microbubbles manipulation can be implemented in any other applications related to stirring and mixing of small volume of liquids.

Although the invention herein has been described with respect to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An apparatus for stirring a liquid comprising:

a resonator cell containing therein said liquid and a plurality of microparticles;

an ultrasound transducer acoustically coupled to said resonator cell; and a control system including a microprocessor adapted to drive said transducer in a swept-frequency mode by varying a frequency of the driving signal of said transducer in a range from a predefined minimum frequency to a predefined maximum frequency, said predefined minimum and maximum frequencies are selected to include therebetween at least two resonance frequencies of said liquid in said cell, said control system further including a voltage control oscillator adapted to send a driving signal to said transducer through a complex resistor, said oscillator controlled by said microprocessor defining the driving signal frequency of said transducer, said control system further including an amplitude or phase detector adapted to receive the driving signal from said complex resistor and further adapted to provide a feedback signal to said microprocessor indicating changes in electrical impedance of said transducer in vicinity of said resonance frequencies.

2. The apparatus as in claim 1, wherein said microprocessor is further adapted to detect a set of resonance frequencies of said liquid in said resonator cell from said feedback signal by sweeping said driving signal in said frequency range, each resonance frequency is identified from a peak in said electrical impedance of said transducer.

3. The apparatus as in claim 2, wherein said microprocessor is adapted to drive said transducer at a frequency repeatedly switching stepwise from one said resonance frequency to another said resonance frequency, said resonance frequencies are selected from said set of resonance frequencies.

4. The apparatus as in claim 3, wherein said control system is further adapted to drive said transducer at each resonance frequency before switching to another resonance frequency for a period of time sufficiently long to allow said microparticles to substantially reach their plurality of locations as defined by a nodal pattern of a standing wave associated with each resonance frequency.

5. An apparatus for stirring a liquid comprising:

a resonator cell containing therein said liquid and a plurality of microparticles;

a plane-parallel ultrasound transducer acoustically coupled to said resonator cell, said transducer adapted to serve as both a reflector and a receiver of ultrasound; and a control system including a microprocessor adapted to drive said transducer in a swept-frequency mode by varying a frequency of the driving signal of said transducer in a range from a predefined minimum frequency to a predefined maximum frequency, said predefined minimum and maximum frequencies are selected to include therebetween at least two resonance frequencies of said liquid in said cell, said control system further including a broadband amplifier, a phase-locked loop chip, and a bandpass filter.

6. The apparatus as in claim 5, wherein said microprocessor is adapted to switch said driving signal frequency of said transducer from one resonance frequency to another by inverting a phase of said phase-locked loop chip.

7. An apparatus for stirring a liquid comprising:

a resonator cell containing therein said liquid and a plurality of microparticles, said microparticles are magnetic microbeads, said resonator cell including at least a first inlet, a second inlet, and an outlet equipped with an electromagnet adapted for capturing said magnetic microbeads;

an ultrasound transducer acoustically coupled to said resonator cell; and a control system including a microprocessor adapted to drive said transducer in a swept-frequency mode by varying a frequency of the driving signal of said transducer in a range from a predefined minimum frequency to a predefined maximum frequency, said predefined minimum and maximum frequencies are selected to include therebetween at least two resonance frequencies of said liquid in said cell.

* * * * *